US009240176B2

(12) United States Patent
Tzirkel-Hancock et al.

(10) Patent No.: US 9,240,176 B2
(45) Date of Patent: Jan. 19, 2016

(54) ACTIVE NOISE CONTROL SYSTEM AND METHOD

(71) Applicant: GM Global Technology Operations LLC, Detroit, MI (US)

(72) Inventors: Eli Tzirkel-Hancock, Ra'anana (IL); Igal Bilik, Rehovot (IL); Moshe Laifenfeld, Haifa (IL); Scott M. Reilly, Southfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 241 days.

(21) Appl. No.: 13/763,207

(22) Filed: Feb. 8, 2013

(65) Prior Publication Data

US 2014/0226831 A1 Aug. 14, 2014

(51) Int. Cl.
*G10K 11/00* (2006.01)
*G10K 11/178* (2006.01)

(52) U.S. Cl.
CPC ..... *G10K 11/002* (2013.01); *G10K 11/178* (2013.01); *G10K 2210/1282* (2013.01); *G10K 2210/3026* (2013.01); *G10K 2210/3226* (2013.01)

(58) Field of Classification Search
CPC ..... G10K 11/002; G10K 11/178; G10K 2210/3026; G10K 2210/1282; G10K 2210/3226
USPC ..... 280/735; 381/60, 71.1, 71.3, 71.6, 71.7, 381/71.11, 94.1, 71.4, 71.14, 372; 600/410; 704/2, 226
See application file for complete search history.

(56) References Cited

U.S. PATENT DOCUMENTS

| | | | | |
|---|---|---|---|---|
| 5,187,692 | A | 2/1993 | Haneda et al. | |
| 5,600,729 | A | 2/1997 | Darlington et al. | |
| 6,007,095 | A | 12/1999 | Stanley | |
| 6,168,198 | B1 * | 1/2001 | Breed et al. | 280/735 |
| 6,304,179 | B1 | 10/2001 | Lotito et al. | |
| 6,396,930 | B1 * | 5/2002 | Vaudrey et al. | 381/60 |
| 6,463,316 | B1 * | 10/2002 | Brungart | 600/410 |
| 7,813,520 | B2 * | 10/2010 | Von Dach et al. | 381/372 |
| 8,077,873 | B2 * | 12/2011 | Shridhar et al. | 381/71.1 |
| 8,135,140 | B2 * | 3/2012 | Shridhar et al. | 381/71.14 |
| 8,189,799 | B2 * | 5/2012 | Shridhar et al. | 381/71.1 |

(Continued)

OTHER PUBLICATIONS

Thomson Search Services Summary Search Report conducted for U.S. Appl. No. 13/763,207 on Sep. 18, 2012.

(Continued)

*Primary Examiner* — Gerald Gauthier
(74) *Attorney, Agent, or Firm* — Ingrassia Fisher & Lorenz, P.C.

(57) ABSTRACT

Methods and systems are provided for active noise control in a vehicle. The system includes a position sensor for sensing an occupant position. A microphone receives audible noise and generates an error signal corresponding to the audible noise. A first controller is configured to receive the error signal from the microphone and generate a modified error signal by modifying the error signal based on the occupant position with respect to the microphone. A second controller is in communication with the first controller and configured to generate an anti-noise signal based at least in part on the modified error signal. The system also includes a loudspeaker in communication with the second controller for receiving the anti-noise signal from the second controller and producing sound corresponding to the anti-noise signal to negate at least some of the audible noise.

20 Claims, 4 Drawing Sheets

(56) References Cited

U.S. PATENT DOCUMENTS

| | | | | |
|---|---|---|---|---|
| 8,199,923 | B2 | 6/2012 | Christoph | |
| 8,571,226 | B2 * | 10/2013 | Isberg | 381/71.1 |
| 8,718,289 | B2 * | 5/2014 | Shridhar et al. | 381/71.1 |
| 8,848,936 | B2 * | 9/2014 | Kwatra et al. | 381/71.1 |
| 8,855,329 | B2 * | 10/2014 | Slapak et al. | 381/71.3 |
| 8,908,877 | B2 * | 12/2014 | Abdollahzadeh Milani et al. | 381/71.1 |
| 8,948,407 | B2 * | 2/2015 | Alderson et al. | 381/71.11 |
| 8,958,571 | B2 * | 2/2015 | Kwatra et al. | 381/94.1 |
| 2004/0170286 | A1 | 9/2004 | Durach et al. | |
| 2009/0208025 | A1 * | 8/2009 | Hayashi et al. | 381/71.4 |
| 2009/0274320 | A1 | 11/2009 | Kino et al. | |
| 2010/0250231 | A1 * | 9/2010 | Almagro | 704/2 |
| 2011/0158420 | A1 * | 6/2011 | Hannah | 381/71.6 |
| 2012/0029912 | A1 * | 2/2012 | Almagro | 704/226 |
| 2012/0308025 | A1 * | 12/2012 | Hendrix et al. | 381/71.11 |
| 2012/0308028 | A1 * | 12/2012 | Kwatra et al. | 381/71.11 |
| 2013/0301842 | A1 * | 11/2013 | Hendrix et al. | 381/71.1 |
| 2013/0301846 | A1 * | 11/2013 | Alderson et al. | 381/71.7 |
| 2013/0301847 | A1 * | 11/2013 | Alderson et al. | 381/71.11 |
| 2013/0301848 | A1 * | 11/2013 | Zhou et al. | 381/71.11 |
| 2014/0044275 | A1 * | 2/2014 | Goldstein et al. | 381/71.6 |
| 2014/0072134 | A1 * | 3/2014 | Po et al. | 381/71.11 |
| 2014/0226831 | A1 * | 8/2014 | Tzirkel-Hancock et al. | 381/71.7 |

OTHER PUBLICATIONS

Waite, Thomas Chapin, "Frequency Domain Active Noise Control with Ultrasonic Tracking" (2010). Graduate Theses and Dissertations. Paper 11782.

Moreau, Danielle, et al., "Active Noise Control at a Moving Virtual Sensor in Three-Dimensions," School of Mechanical Engineering, the University of Adelaide, Adelaide SA 5005 Australia, Oct. 15, 2008, pp. 1-8.

* cited by examiner

ACTIVE NOISE CONTROL SYSTEM AND METHOD

TECHNICAL FIELD

The technical field generally relates to an active noise control system and method, and more particularly relates to an active noise control system and method for a vehicle.

BACKGROUND

Active noise control ("ANC"), often referred to as "active noise cancellation", has been implemented in vehicles to reduce engine noise and other undesirable noises heard by vehicle occupants. However, such vehicular ANC systems have suffered several shortfalls. For instance, the interior of the vehicle creates a complex acoustic cavity in which audible signals, i.e., sounds, are perceived differently depending on the location. As such, the attempts at noise cancellation are typically more generic in nature, attempting to satisfy either one typical occupant or all occupants, regardless of the actual number of occupants and their positions in the vehicle. As a result, ANC in vehicles is often limited to very low frequencies, e.g., frequencies under 150 Hz.

Accordingly, it is desirable to provide noise cancellation that is customized for the current occupants of the vehicle. In addition, it is desirable to provide noise cancellation at frequencies greater than 150 Hz. Furthermore, other desirable features and characteristics of the present invention will become apparent from the subsequent detailed description and the appended claims, taken in conjunction with the accompanying drawings and the foregoing technical field and background.

SUMMARY

An active noise control method is provided. In one embodiment, the method includes sensing an occupant position of an occupant within a defined space. The method further includes receiving an error signal from a microphone disposed at a location within the defined space. A modified error signal is generated by modifying the error signal based on the occupant position with respect to the microphone location. The method also includes generating an anti-noise signal based at least in part on the modified error signal. Further, the anti-noise signal is transmitted to a loudspeaker.

An active noise control system is also provided. In one embodiment, the system includes a position sensor for sensing an occupant position of an occupant within a defined space. A microphone is disposed at a location within the defined space for receiving audible noise and generating an error signal corresponding to the audible noise. The system further includes a first controller in communication with the position sensor and the microphone and configured to receive the error signal from the microphone and generate a modified error signal by modifying the error signal based on the occupant position with respect to the microphone location. A second controller is in communication with the first controller and configured to generate an anti-noise signal based at least in part on the modified error signal. The system also includes a loudspeaker in communication with the second controller for receiving the anti-noise signal from the second controller and producing sound corresponding to the anti-noise signal to negate at least some of the audible noise.

DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description.

Referring to the figures, wherein like numerals indicate like parts throughout the several views, a vehicle 100 having an active noise control system 102 is shown herein. In the exemplary embodiments shown herein, the vehicle 100 is an automobile (not separately numbered). However, the active noise control system 102 described herein may be implemented and/or utilized in other types of vehicles 100 or in non-vehicle applications. For instance, other vehicles 100, may include, but are not limited to, aircraft (not shown). Non-vehicle applications include, but are not limited to, offices in a factory environment (not shown).

Figure 1:
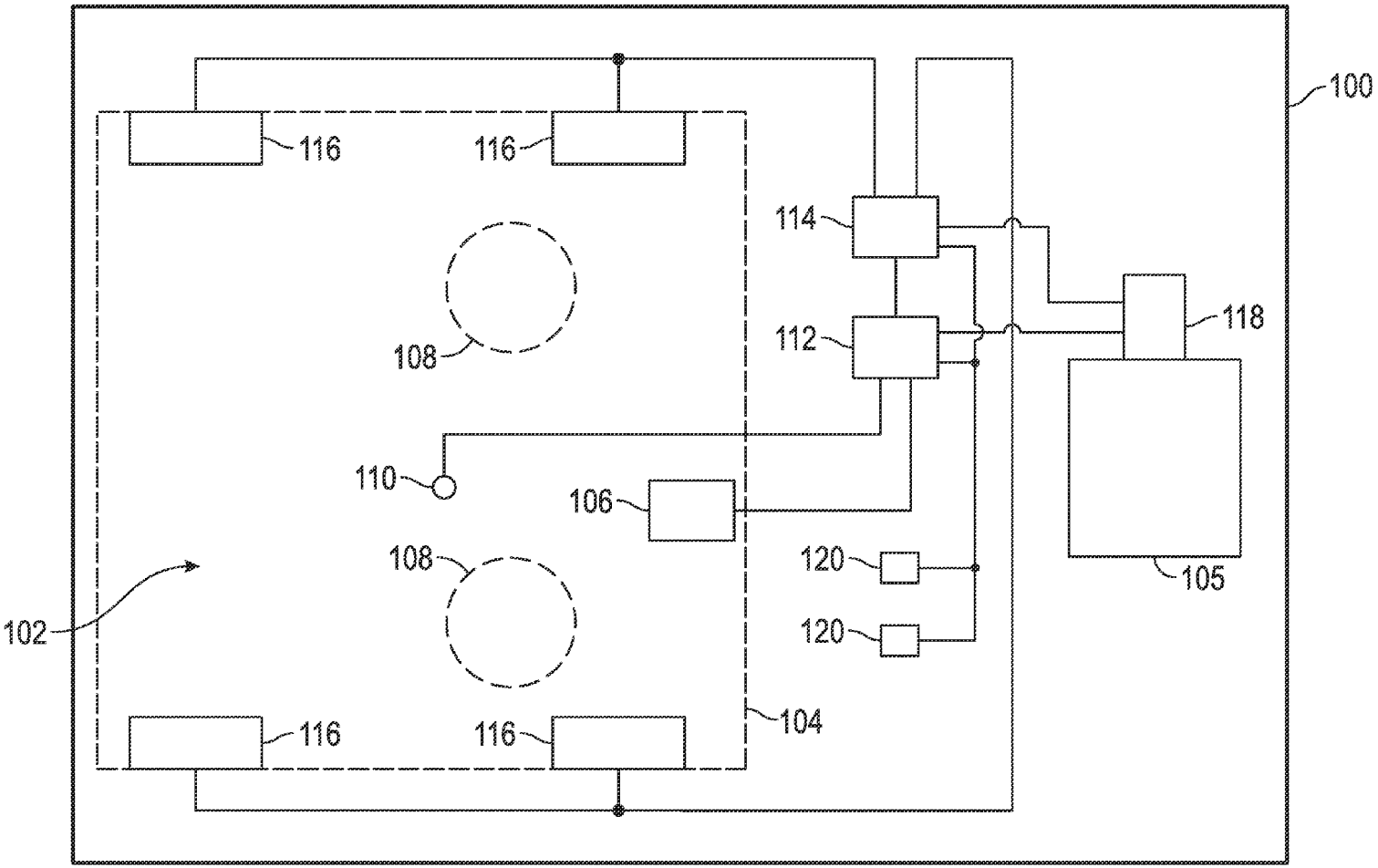
FIG. 1 is block diagram of a vehicle including an active noise control system according to an exemplary embodiment.

With reference to FIG. 1, the vehicle 100 of the exemplary embodiments defines a defined space 104. Specifically, in the exemplary embodiments, the defined space 104 is a passenger compartment (not separately numbered) of the vehicle 100. The passenger compartment accommodates one or more individuals, i.e., occupants of the vehicle 100, e.g., a driver and passenger(s). The automobile of the exemplary embodiments includes a powertrain (not numbered) including an engine 105 coupled to at least one wheel (not shown) via a transmission (not shown) to propel the vehicle 100 as is well known to those skilled in the art.

The system 102 includes a position sensor 106 configured to sense an occupant position of an occupant 108 within the defined space 104. In the exemplary embodiments, the position sensor 106 is configured to sense the position of each occupant 108. That is, the position sensor 106 is configured to sense a plurality of occupant positions of a plurality of occupants 108. Accordingly, the position sensor 106 may also determine the number of occupants 108. For instance, the position sensor 106 may be utilized to sense the position of two occupants 108, e.g., a first occupant 108 and a second occupant 108. However, the position sensor 106 may be configured to only sense the position of one occupant 108, for example, a driver (not separately numbered) of the vehicle 100.

The position sensor 106 may be configured to repeatedly determine the position of the occupant(s) 108 at any time the system 102 is in operation. As such, the position of each occupant 108 may be updated as the occupant 108 changes position within the defined space 104.

For readability, the description hereafter may refer to a single occupant 108. However, this should not be in any way read as limiting, as the position sensor 106 of the exemplary embodiments is configured to sense a position of a plurality of occupants 108.

More specifically, the position sensor 106 is configured to sense the position of the head of the occupant 108. Even more specifically, the position sensor 106 is configured to sense the position of at least one of the ears of the occupant 108 and/or determine a midpoint between the ears on an imaginary line connecting the ears of the occupant 108. As such, the occupant position, as used hereafter, may be considered as the position of at least one of the ears of the occupant 108 of the vehicle 100.

In the exemplary embodiments, the position sensor 106 utilizes sound waves in an ultrasonic range to determine the position of the occupant 108 of the vehicle 100. As such, sound waves in this range are outside that of typical human hearing and therefore will not distract the occupants or should not pose privacy concerns. Accordingly, the position sensor 106 may be referred to as an ultrasonic position sensor (not separately numbered).

Figure 2:
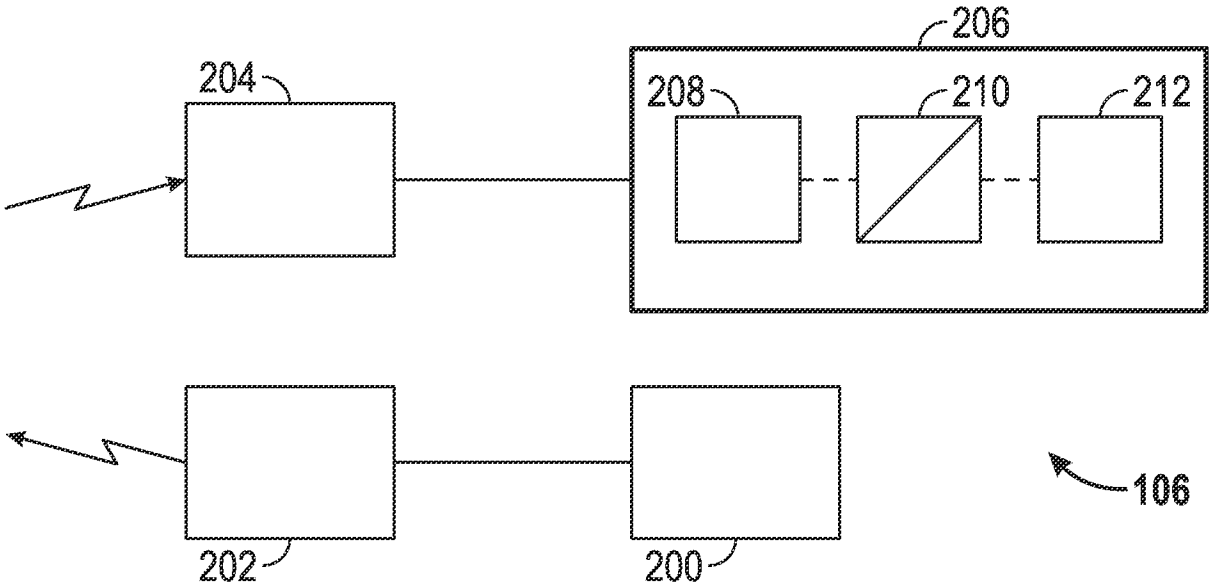
FIG. 2 is block diagram of a position sensor of the system in accordance with an exemplary embodiment.

Referring now to FIG. 2, the position sensor 106 of the exemplary embodiments includes a signal generator 200. The signal generator 200 may be configured to generate a high-voltage continuous wave ("CW") signal and/or a plurality of high-voltage pulses. Other types of signals may alternatively be generated by the signal generator 200 as appreciated by those skilled in the art. A plurality of ultrasonic transmitters 202 are electrically coupled to the signal generator 200. The ultrasonic transmitters 202, commonly referred to as transmitting transducers, generate sound waves in the ultrasonic range. The sound waves generated by the ultrasonic transmitters 202 correspond to the signal generated by the signal generator 200. Specifically, in the exemplary embodiments, the sound waves have a frequency of about 100 kHz and an effective bandwidth of about 25 kHz. Of course, other suitable frequencies for the sound waves in the ultrasonic range will be realized by those skilled in the art.

The sound waves reflect off of objects disposed in the defined space 104 including the occupant 108. The position sensor 106 of the exemplary embodiments further includes a plurality of ultrasonic receivers 204 for receiving these reflected sound waves. Specifically, in the exemplary embodiments, about 16 ultrasonic receivers 204 are utilized to receive the reflected sound waves; however, a different number of ultrasonic receivers 204 could be employed. The ultrasonic receivers 204, commonly referred to as transducer receivers, generate a plurality of received signals corresponding to the received reflected sound waves.

Although the ultrasonic transmitters 202 and receivers 204 are described above imply separate devices, they may be combined into a transceiver (not shown) as appreciated by those skilled in the art.

With continued reference to FIG. 2, the position sensor 106 also includes a processing unit 206 electrically coupled to the ultrasonic receivers 204. The processing unit 206 receives the received signals from the ultrasonic receivers 204 and is configured to determine the position of the occupant 108 of the vehicle 100 as well as the number of occupants 108. More specifically, in the illustrated embodiment, the processing unit 206 is configured to determine the position of at least one of the ears of each of the occupants 108 of the vehicle 100. The processing unit 206 of the illustrated embodiment includes conditioning circuitry 208 coupled to the ultrasonic receivers 204, an analog-to-digital converter ("ADC") 210 coupled to the conditioning circuitry 208, and a microprocessor 212 coupled to the ADC 210. However, the specific design parameters of the processing unit 206 may vary as is realized by those skilled in the art.

In another exemplary embodiment (not shown), the position sensor 106 may utilize radio waves to determine the position of the occupant 108 of the vehicle 100. Said another way, the position sensor 106 may utilize radar for determining the position of the occupant 108. For instance, the position sensor 106 may utilize a linear frequency modulated ("LFM") CW signal or an ultra-wideband ("UWB") pulse signal. Such signals, having a bandwidth of about 4 GHz at a transmission power on the order of milliwatts (mW), would be capable of achieving a resolution of about 4 cm. Of course, other suitable configurations will be realized by those skilled in the art.

In yet another exemplary embodiment (not shown), the position sensor 106 utilizes infrared waves to determine the position of the occupant of the vehicle. For example, the position sensor 106 may include a camera (not shown) with an infrared light source (not shown).

In yet a further exemplary embodiment (not shown), the position sensor 106 may include one or more pressure sensors. The pressure sensor(s) may be disposed in seats of the vehicle to detect the presence of the occupant 108. The pressure sensor(s) may also be used in concert with the radar or camera configurations described above. As such, the pressure sensor(s) may be utilized in areas of the vehicle 100 that are obscured from the radar or camera configurations or to provide verification of the positions generated by the radar or camera configurations. Furthermore, the system 102 of this further exemplary embodiment may also utilize anthropometric data in concert with the pressure sensors to determine head and/or ear position of the occupant 108. For example, the system 102 may have access to a height information of the occupant 108. With that height information, combined with the pressure sensor data indicating the presence of the occupant 108, the system 102 of this embodiment is configured to calculate the position of at least one of the ears of the occupant 108 and/or determine a midpoint between the ears on an imaginary line connecting the ears of the occupant 108.

Figure 3:
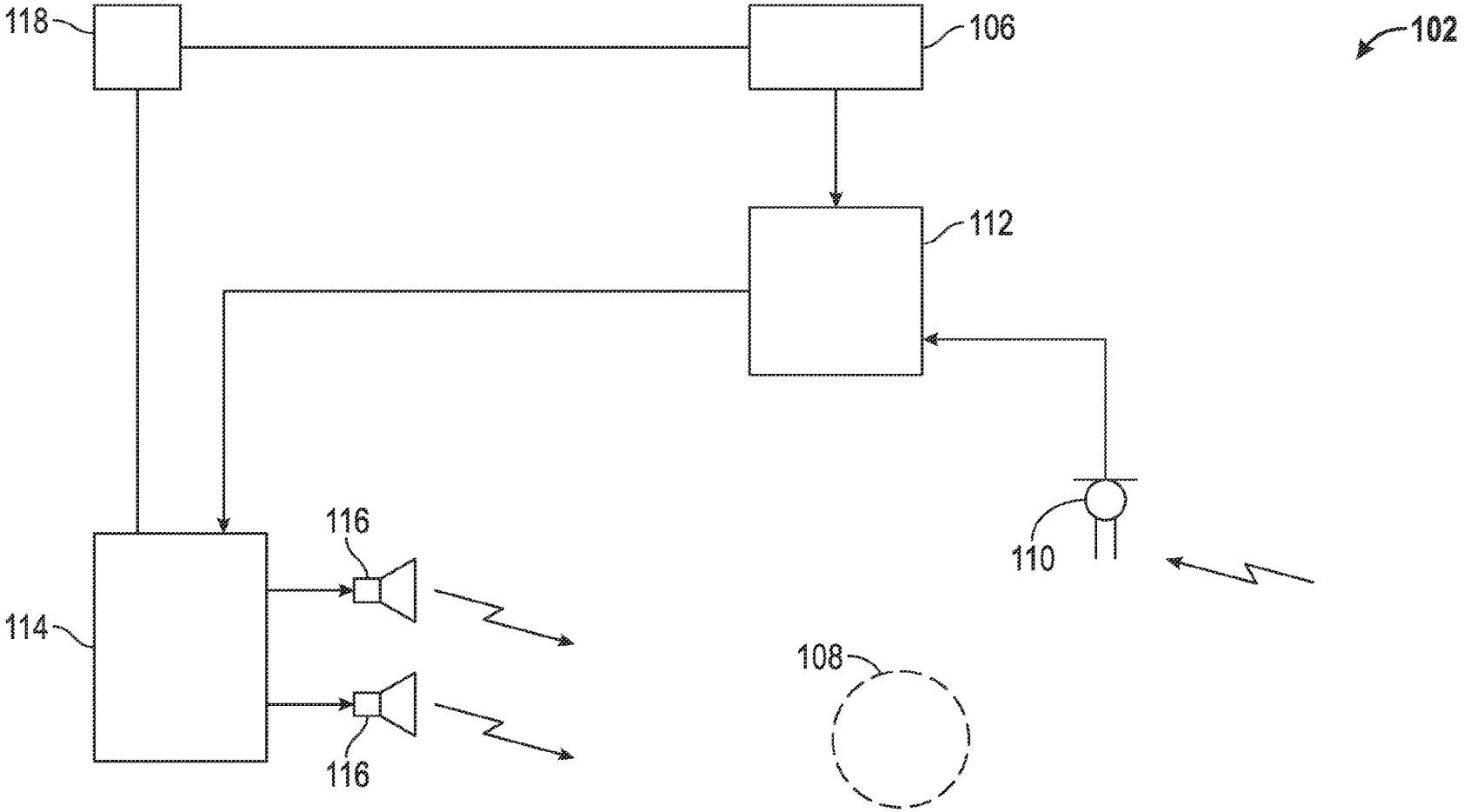
FIG. 3 is block diagram of the active noise control system according to one exemplary embodiment.

Referring again to FIG. 1, the system 102 also includes at least one microphone 110 for receiving audible signals including audible noise. The microphone 110 shown in the exemplary embodiments is disposed at a location within the defined space 104. In one exemplary embodiment, as shown in FIGS. 1 and 3, the system 102 includes a single microphone 110. The microphone 110 is disposed at a location different from the occupant positions. For instance, the microphone 110 may be disposed in a headliner (not shown) of the vehicle 100. The microphone 110 generates an error signal corresponding to the audible signals received.

Figure 4:
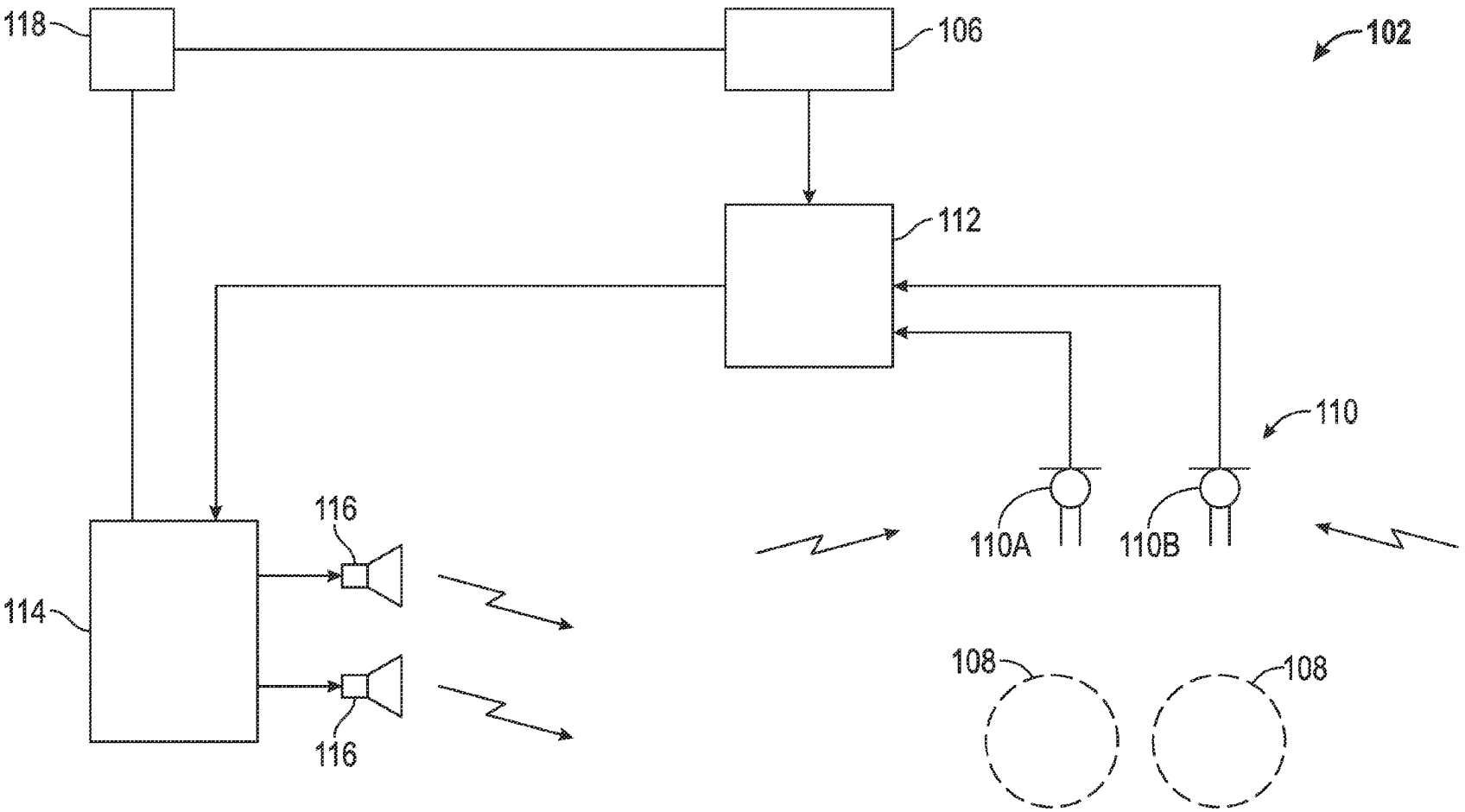
FIG. 4 is block diagram of the active noise control system according to another exemplary embodiment.

In another exemplary embodiment, as shown in FIG. 4, the system 102 includes a first microphone 110A and a second microphone 110B disposed within the defined space 108. More specifically, the first microphone 110A is disposed at a first location (not numbered) and the second microphone 110B is disposed at a second location (not numbered) different from the first location. The first microphone 110A generates a first error signal and the second microphone 110B generates a second error signal, each error signal corresponding to the audible signals received by the respective microphone 110A, 110B.

Referring to FIGS. 1, 3, and 4, the system 102 further includes a first controller 112 in communication with the position sensor 106 and the microphone 110. The first controller 112 may comprise a microprocessor, microcontroller, application specific integrated circuit, or other suitable device able to perform calculations and/or execute programs or other instructions. In the embodiment shown in FIGS. 1 and 3, the first controller 112 is configured to receive the error signal from the microphone 110 and the occupant position from the position sensor 106. Furthermore, the first controller 112 is configured to generate a modified error signal by modifying the error signal based on the occupant position with respect to the location of the microphone 110.

In some embodiments, the first controller 112 may generate a single modified error signal that takes into account multiple occupant positions. In other embodiments, the first controller 112 may be configured to produce multiple error signals, wherein each error signal corresponds to each occupant 108. Furthermore, the modified error signal(s) may be adjusted as the occupant(s) 108 moves within the defined space 104.

The process of modifying of the received error signal to generate the modified error signal may include utilizing an acoustic transfer function. More specifically, an estimated inverse of the acoustic transfer function between the occupant position, i.e., the position of occupant's head, and the location of the microphone 110. In one configuration, the acoustic transfer function may be estimated using a standard formula which utilizes the distance(s) between the location of the microphone 110 and the occupant position(s).

In another configuration, a plurality of calibration signals are taken with a calibration microphone (not shown) at a plurality of locations throughout the defined space 104 from a common audible signal, such as, a running engine 105. This procedure need only take place during development of the vehicle 100, and may not be necessary for each vehicle 100 being produced. In executing the procedure, the defined space 104 may be divided with a volumetric grid into the plurality of locations. In one embodiment, the audio measurements are taken both with the system 102 operating, i.e., providing noise cancellation as described below, and with the system 102 non-operational. The audio measurements, i.e., the calibration signals, taken at each location with the calibration microphone may then be compared with the error signal received from the microphone 110 that corresponds to the common audible signal. The acoustic transfer function may then be established for each location in the volumetric grid and stored for use with the first controller 112.

In the exemplary embodiment shown in FIG. 4, the first controller 112 is configured to receive the first error signal from the first microphone 110A and the second error signal from the second microphone 110B. In response to receiving the first and second error signals, the first controller 112 generates a modified error signal by combining the first and second error signals into a combined error signal and modifying the combined signal based on the occupant position with respect to the first and second locations of the first and second microphones 110A, 110B. More specifically, a single modified error signal may be generated and/or multiple modified error signals, with each modified error signal corresponding to each occupant 108, may be generated. With the use of multiple microphones 110A, 110B, the system 102 provides spatial filtering, which results in even more accurate modified error signals produced by the first controller 112.

Referring again to FIGS. 1, 3, and 4, the system 102 also includes a second controller 114 in communication with the first controller 112. The second controller 114 is configured to generate an anti-noise signal based at least in part on the modified error signal received from the first controller 112. The anti-noise signal is generated by an adaptive filter tuned for minimizing the modified error signal.

The second controller 114 may include a microprocessor or other similar device for performing calculations and executing instructions. Furthermore, the first controller 112 and the second controller 114 may be integrated together as a single controller (not shown) or part of the single controller. For instance, one microprocessor may execute the instructions and perform the calculations of both the first and second controllers 112, 114.

A loudspeaker 116, commonly referred to simply as a "speaker", is in communication with the second controller 114. For example, the loud speaker 116 may be electrically connected to the loudspeaker 116. The loudspeaker 116 receives the anti-noise signal from the second controller and produces sound corresponding to the anti-noise signal to negate at least some of the audible noise. The system 102 may include more than one loudspeaker 116, as shown.

The loudspeaker 116 may be part of an audio system (not shown) for the vehicle 100. As such, the same loudspeaker 116 that provides music or other audio entertainment to the occupants 108 may also be utilized to provide the anti-noise signal for canceling and/or decreasing unwanted noise.

The second controller 114 may be configured to generate a plurality of anti-noise signals. In one embodiment, the second controller 114 is configured to generate an anti-noise signal to correspond with each loudspeaker 116. More specifically, each anti-noise signal may correspond with one of the plurality of modified error signals generated by the first controller 112. As such, the system 102 customizes the anti-noise signals converted into sound at each loudspeaker 116 in accordance with the positions of the occupants 108 of the vehicle 100. Such customization allows for a more exact match of the noise cancellation efforts perceived by each occupant 108.

Referring to FIG. 1, the vehicle 100 may include a powertrain control module 118 for controlling one or more aspects of the powertrain. The powertrain control module 118 may comprise an engine control module ("ECM") (not separately numbered) for controlling operation of the engine 105 and/or a transmission control module ("TCM") (not separately numbered) for controlling operation of the transmission.

The powertrain control module 118 of the exemplary embodiments is in communication with the first controller 112 and/or the second controller 114. The communication between the powertrain control module 118 and the controllers 112, 114 may be utilized for several purposes. In one technique, powertrain performance data regarding performance of the powertrain may be sent from the powertrain control module 118 to the controllers 112, 114. For instance, the revolutions per minute ("RPMs") of the engine 105 and/or the transmission may be sent to the controllers 112, 114. The controllers 112, 114 may then utilize this information in modifying the error signal to generate the modified error signal and the anti-noise signal. For example, the controllers 112, 114 may only process the error signal at frequencies corresponding to the RPMs of the engine 105 and/or the transmission. As such, undesirable noise from the engine and/or transmission is canceled at the relevant instantaneous frequencies.

In another technique, data regarding performance of the system 102 may be sent from the controllers 112, 114 to the powertrain control module 118. This data may include the frequencies that the system 102 is able to effectively cancel based on the number and/or location of the occupants 108. By utilizing this data, the powertrain control module 118 may regulate the engine 105 and/or the transmission to operate at RPMs corresponding to frequencies that can be effectively canceled. This may provide fuel economy and efficiency advantages. For instance, a diesel engine may be operated at lower RPMs that result in greater efficiency, but, without effective noise canceling, would be intolerable to the occupants 108.

Still referring to FIG. 1, the system 102 may further include one or more sensors 120 for sensing the position of one or more structural elements (not shown) of the vehicle 100. These structural elements may include, but are not limited to, windows, convertible roofs, and foldable seats of the vehicle 100. The sensor(s) 120 are in communication with the first controller 112. The first controller 112 may be configured to utilize the position of the structural element(s), and the corresponding change in apertures that result, in modifying the error signal to generate the modified error signal.

For instance, one or more sensors 120 may be utilized with each window of the vehicle 100. As such, the size of the aperture generated by opened or partially opened windows may be ascertained. Opening the windows changes dimensions and/or size of the defined space 104 and modifies the transfer function between the user ear and the microphone 110. Opening the windows also modifies the transfer function between the loudspeaker 116 and the occupant 108 and/or the microphone 110. The first controller 112 and/or the second controller 114 are programmed to compensate accordingly for such changes. Of course, other changes in apertures, e.g., foldable seats, may be utilized by the system 102.

Changes in apertures cause by opening the windows, folding the seats down, etc. may also be sensed by the position sensor 106. This sensing may be done in addition to, or instead of, the sensing by the sensors 120 described above.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. An active noise control method, comprising:

sensing an occupant position of an occupant within a defined space;

receiving an error signal from a microphone disposed at a microphone location within the defined space;

generating an anti-noise signal with a microprocessor based at least in part on the error signal and the sensed occupant position; and transmitting the anti-noise signal to a loudspeaker to produce sound corresponding to the anti-noise signal.

2. A method as set forth in claim 1 further comprising generating a modified error signal by modifying the error signal based on the occupant position with respect to the microphone location and wherein generating an anti-noise signal is based at least in part on the modified error signal.

3. A method as set forth in claim 2 wherein generating a modified error signal by modifying the received error signal comprises utilizing an estimate of an acoustic transfer function between the occupant position and the microphone location.

4. A method as set forth in claim 2 wherein sensing the occupant position is further defined as sensing a first occupant position of a first occupant and sensing a second occupant position of a second occupant; and generating a modified error signal is further defined as generating a modified error signal by modifying the received error signal based on the first occupant position with respect to the microphone location and the second occupant position with respect to the microphone location.

5. A method as set forth in claim 2 wherein sensing the occupant position is further defined as sensing a first occupant position of a first occupant and sensing a second occupant position of a second occupant; and generating a modified error signal is further defined as generating a first modified error signal by modifying the received error signal based on the first occupant position with respect to the microphone location and generating a second modified error signal by modifying the received error signal based on the second occupant position with respect to the microphone location.

6. A method as set forth in claim 5 wherein generating the anti-noise signal is further defined as a generating a first anti-noise signal based at least in part on at least one of the first and second modified error signals and generating a second anti-noise signal based at least in part on at least one of the first and second modified error signals; and transmitting the anti-noise signal to the loudspeaker is further defined as transmitting the first anti-noise signal to a first loudspeaker and transmitting the second anti-noise signal to a second loudspeaker.

7. A method as set forth in claim 2 wherein sensing the occupant position is further defined as sensing a plurality of occupant positions for each of a plurality of occupants; and generating a modified error signal is further defined as generating a plurality of modified error signals by modifying the received error signal based on each of the plurality of occupant positions with respect to the microphone location.

8. A method as set forth in claim 2 wherein receiving an error signal is further defined as receiving a first error signal from a first microphone disposed at a first microphone location within the defined space and receiving a second error signal from a second microphone disposed at a second microphone location within the defined space and different from the first microphone location; and generating a modified error signal is further defined as generating a modified error signal by combining the first and second error signals into a combined error signal and modifying the combined signal based on the position of the individual with respect to the first and second microphone locations.

9. A method as set forth in claim 2 further comprising receiving powertrain performance data from a powertrain control module and wherein generating a modified error signal is further defined as generating a modified error signal by modifying the error signal based on the occupant position with respect to the microphone location and the powertrain performance data.

10. A method as set forth in claim 1 wherein the occupant position is further defined as the position of at least one of the ears of an occupant of the vehicle.

11. An active noise control system, comprising:

a position sensor for sensing an occupant position of an occupant within a defined space;

a microphone disposed at a microphone location within the defined space for receiving audible noise and generating an error signal corresponding to the audible noise;

a first controller in communication with said position sensor and said microphone and configured to receive the error signal from the microphone and generate a modified error signal by modifying the error signal based on the occupant position with respect to the microphone location;

a second controller in communication with said first controller and configured to generate an anti-noise signal based at least in part on the modified error signal; and a loudspeaker in communication with said second controller for receiving the anti-noise signal from said second controller and producing sound corresponding to the anti-noise signal to negate at least some of the audible noise.

12. A system as set forth in claim 11 wherein said microphone is further defined as a first microphone disposed at a first microphone location and a second microphone disposed at a second microphone location different from the first microphone location.

13. A system as set forth in claim 12 wherein said first controller is configured to receive the first error signal from said first microphone and the second error signal from said second microphone and generate a modified error signal by combining the first and second error signals into a combined error signal and modifying the combined signal based on the occupant position with respect to the first and second microphone locations.

14. A system as set forth in claim 11 wherein said position sensor comprises:

a signal generator;

a plurality of ultrasonic transmitters electrically coupled to said signal generator for generating sound waves in the ultrasonic range;

a plurality of ultrasonic receivers for receiving reflected sound waves in the ultrasonic range and generating a plurality of received signals corresponding to the received reflected sound waves; and a processing unit electrically coupled to said ultrasonic receivers and said first controller for receiving the received signals and determining the occupant position.

15. A system as set forth in claim 11 wherein said position sensor is configured to sense a plurality of occupant positions of a plurality of occupants of the vehicle and wherein said first controller is configured to generate a modified error signal by modifying the received error signal based on the plurality of occupant positions.

16. A system as set forth in claim 11 further comprising a sensor for sensing a size of a changeable aperture which changes dimensions of the defined space and wherein said first controller is configured to adjust the modified error signal based on the changes to the defined space.

17. A vehicle having, comprising:

a passenger compartment; and an active noise control system including a position sensor for sensing an occupant position of an occupant in said passenger compartment, a microphone disposed at a microphone location in said passenger compartment different from the occupant position for receiving audible noise and generating an error signal corresponding to the audible noise, a first controller in communication with said position sensor and said microphone and configured to receive the error signal from the microphone and generate a modified error signal by modifying the error signal based on the occupant position with respect to the microphone location, a second controller in communication with said first controller and configured to generate an anti-noise signal based at least in part on the modified error signal, and a loudspeaker in communication with said second controller for receiving the anti-noise signal from said second controller and producing sound corresponding to the anti-noise signal to negate at least some of the audible noise.

18. A vehicle as set forth in claim 17 further comprising a powertrain for propelling said vehicle and a powertrain control module for controlling operation of said powertrain in communication with said first controller.

19. A vehicle as set forth in claim 17 wherein said first controller is configured to receive powertrain performance data from said powertrain control module and generate a modified error signal by modifying the error signal based on the occupant position with respect to the microphone location and the powertrain performance data.

20. A vehicle as set forth in claim 17 wherein said powertrain control module is configured to receive data regarding performance of the active noise control system.

* * * * *